US007198524B2

(12) United States Patent
Tsugane et al.

(10) Patent No.: US 7,198,524 B2
(45) Date of Patent: Apr. 3, 2007

(54) BUSBAR MOLDED ARTICLE, PROCESS FOR MANUFACTURING THE SAME AND ELECTRONIC UNIT

(75) Inventors: Hitoshi Tsugane, Shizuoka (JP); Yoshihiko Nakahama, Aichi (JP)

(73) Assignee: Yazaki Corporation, Tokyo (JP)

( * ) Notice: Subject to any disclaimer, the term of this patent is extended or adjusted under 35 U.S.C. 154(b) by 46 days.

(21) Appl. No.: 10/990,682

(22) Filed: Nov. 18, 2004

(65) Prior Publication Data

US 2005/0112956 A1 May 26, 2005

(30) Foreign Application Priority Data

Nov. 26, 2003 (JP) ..... 2003-395135

(51) Int. Cl.
*H01R 13/405* (2006.01)

(52) U.S. Cl. ..... 439/736; 439/212

(58) Field of Classification Search ..... 439/736, 439/212, 722, 723, 604
See application file for complete search history.

(56) References Cited

U.S. PATENT DOCUMENTS 6,004,160 A * 12/1999 Korsunsky et al. ..... 439/660
6,319,072 B1 * 11/2001 Takahashi ..... 439/736
6,444,911 B2 * 9/2002 Maruyama et al. ..... 174/70 B
6,702,624 B2 * 3/2004 Akimoto et al. ..... 439/736
7,000,317 B1 * 2/2006 Spykerman ..... 29/883
2003/0228806 A1 * 12/2003 Wang et al. ..... 439/736

FOREIGN PATENT DOCUMENTS

| | | |
|---|---|---|
| JP | 2000-77152 | 3/2000 |
| JP | 2001-251729 | 9/2001 |
| JP | 2001-339825 | 12/2001 |

* cited by examiner

*Primary Examiner*—Hien Vu
(74) *Attorney, Agent, or Firm*—Armstrong, Kratz, Quintos, Hanson & Brooks, LLP

(57) ABSTRACT

The busbar molded article 10 includes: a busbar 12 formed by being stamped out from an electrically conductive substrate; a plurality of terminal parts 17 lined up on the busbar; and a resin band 25 for alignment-correction formed on the side of an end of a plurality of the terminal parts 17, wherein each terminal part 17 is provided with: a first bent part 21 bent by a small bend angle θ1; and a second bent part 22 bent by a large bend angle θ2 by stamping with a pressing machine, the second bent part 22 being formed nearer to the side of a base of each terminal part 17 than the first bent part 21 being formed, so that the resin band 25 is offset to a mold 45 that moves up and down of the pressing machine.

3 Claims, 5 Drawing Sheets

BUSBAR MOLDED ARTICLE, PROCESS FOR MANUFACTURING THE SAME AND ELECTRONIC UNIT

BACKGROUND OF THE INVENTION (1) Field of the Invention

The present invention relates to a busbar molded article including a busbar stamped out from an electrically conductive substrate in a specific circuit pattern and an electrically conductive substrate formed in one piece with the busbar, and to a process for manufacturing the busbar molded article. The present invention also relates to an electronic unit having the busbar molded article, which electronic unit controls an auxiliary machine of a motor vehicle such as a wiper, washer, front light, foglamp and air-conditioner.

(2) Description of the Related Art

An example of such a conventional busbar molded article and a conventional process for manufacturing the busbar molded article is shown in FIGS. 5–7 (Japanese Patent Application Laid-Open No. 2000-77152 and Japanese Patent Application Laid-Open No. 2001-251729).

A conventional example (Japanese Patent Application Laid-Open No. 2000-77152) shown in FIG. 5 relates to a method, in which a pair of grippers 52, 53 that hold a terminal part 50 is rotated by a specific angle so as to be bent as a plurality of the terminal parts 50 received in a connector housing (not shown in the figure) abut against a terminal pedestal 51.

A conventional example (Japanese Patent Application Laid-Open No. 2001-251729) shown in FIG. 6 relates to a terminal part 55 of a busbar 54 to be received in an electric junction box, in which the terminal part 55 is bent by an angle of 90° and twisted so as to be received into a female terminal of the other side, thereby the terminal part 55 faces in the same direction as the female terminal faces, so that the terminal connection can be carried out without putting an intermediate terminal therebetween.

A conventional example shown in FIGS. 7A and 7B relates to a busbar molded article 60 having a plurality of terminal parts 62 for connecting to a substrate, in which the base-side of the terminal part 62 is bent by stamping with a pressing machine so as to form the terminal part 62 L-shaped at an end of a busbar 61. FIG. 7A shows a state before the stamping, in which the terminal part 62, extending straightly on a condition of being stamped out from the conductive substrate, is placed between a lower mold 64 having a L-shaped notch 64*a* and an upper mold 63 that enters into the notch 64*a*. As shown in FIG. 7B, when the upper mold 63 is brought down to the fixed lower mold 64, the base-side of the terminal part 62 is stamped being put between the upper and lower molds 63, 64 so as to be bent into a L-shape corresponding to the notch 64*a* of the lower mold 64.

The terminal part 62 is provided with a resin band 65 for correcting the alignment formed in one piece therewith. Accordingly, after the terminal part 62 is bent, a table 66 on which the busbar molded article 60 is placed is shifted to this side so that the resin band 65 slides along a groove 63*a* of the upper mold 63, thereby the busbar molded article 60 is removed from the pressing machine.

As a further conventional example, in Japanese Patent Application Laid-Open No. 2001-339825, it is described that a conductive substrate is subjected to stamping and bending so as to form a tab-shaped terminal part.

However, as for the conventional examples described above, the following problems exist. In the first conventional example, the terminal part 50 is nipped by a pair of the grippers 52, 53 and bent by rotating the grippers 52, 53 by a specific angle. Therefore, when a plurality of the terminal parts 50 arranged in a row laterally are simultaneously bent, a precise bending of the terminal parts might not be carried out due to a problem of the stiffness of the bending machine. Further, since the bending method of the terminal parts 50 is complicated, the method is not suitable to automation having a problem of efficiency.

In the second conventional example, although the terminal part 55 can be bent with a simple method by using a twisting jig, a plurality of the terminal parts 55 cannot be simultaneously bent, causing low efficiency being not suitable for mass production. A precise bending of the terminal parts 55 might not be carried out with good reproducibility.

In the third conventional example, since a plurality of the terminal parts 62 are nipped between the upper and lower molds 63, 64 of the pressing machine and subjected to stamping, the terminal parts 62 may be bent efficiently precisely. However, since a plurality of the terminal parts 62 are provided with the resin band 65 for correcting the alignment, therefore when the mold 63 is lifted to return it to the original position, the mold 63 might interfere with the resin band 65 (i.e. a problem of undercutting). Accordingly, when the bent busbar molded article 60 is to be removed from the pressing machine, the table 66 on which the busbar molded article 60 is placed must be slid in a direction crossing at right angles with the acting direction of the mold 63, causing an excessive man-hour for the manufacture.

Moreover, when an obstacle such as a rising terminal part or projection exists in the direction in which the table 66 is slid, the table 66 cannot be slid in the direction crossing at right angles with the acting direction of the mold 63 after the terminal part 62 is bent, causing a problem that the busbar molded article 60 cannot be removed from the pressing machine after the bending.

In the fourth conventional example, since a method of bending simultaneously a plurality of the terminal parts arranged in a line is not provided, therefore there is a problem that the efficiency of the bending is low.

SUMMARY OF THE INVENTION

It is therefore an objective of the present invention to solve the above problem and to provide a busbar molded article, by which the interference between the mold that moves up and down and the resin band can be prevented from occurring and the bending can be carried out efficiently precisely, a method of manufacturing such a busbar molded article, and an electronic unit having such a busbar molded article.

In order to attain the above objective, the present invention is to provide a busbar molded article including:

a busbar formed by being stamped out from an electrically conductive substrate;

a plurality of terminal parts lined up on the busbar; and a resin band for alignment-correction formed on the side of ends of a plurality of the terminal parts, wherein each terminal part is provided with:

a first bent part bent by a small bend angle; and a second bent part bent by a large bend angle by stamping with a pressing machine, the second bent part being formed nearer to the side of a base of each terminal part than the first bent part being formed, so that the resin band is offset to a mold that moves up and down of the pressing machine.

With the construction described above, a plurality of the terminal parts formed at an end of the busbar are linked together in a lateral line by the resin band for alignment-correction, thereby preventing each terminal part from shifting and improving the reliability of the terminal connection to a conductor part of the other side. Since the resin band is offset in a direction of leaving from the mold that moves up and down of the pressing machine, the mold is prevented from interfering with the resin band even when the mold is lifted up after the stamping. Accordingly, the man-hour for the manufacture can be reduced and the bending of the terminal parts can be carried out efficiently.

Preferably, the sum of the small bend angle and the large bend angle is 90°.

With the construction described above, electric contacts formed on the side of the end of a plurality of the terminal parts rise up vertically with respect to the busbar molded article. Accordingly, the electric contacts can be precisely positioned with respect to the conductor part of the other side, thereby improving the reliability of the electric connection.

The present invention is also to provide a process for manufacturing a busbar molded article including the steps of:

forming the busbar by stamping out from an electrically conductive substrate and simultaneously forming the first bent parts on a plurality of the terminal parts;

placing the busbar in its expanded state on a mold for forming;

feeding electrically insulating resin so as to insert-mold an intermediate molded body consisting of the busbar and an electrically insulating substrate;

placing the intermediate molded body in a pressing machine; and stamping the side of bases of a plurality of the terminal parts with an upper mold and a lower mold so as to form the second bent parts on a plurality of the terminal parts.

With the construction described above, since the first bent parts are formed simultaneously with the stamping of the busbar, the first bent parts can be formed without increasing the man-hour. Since the busbar is formed in one piece with the insulating substrate, the productivity of the busbar molded article can be improved. Further, the first bent parts are formed in a plurality of the terminal parts so that the resin band is offset in the direction of leaving from the mold that moves up an down. Therefore, even when the mold is lifted up after the second bent part is formed, the mold is prevented from interfering with the resin band. Accordingly, the terminal parts can be bent efficiently.

The present invention is also to provide an electronic unit including:

the busbar molded article as defined above; and a circuit board, wherein a plurality of the terminal parts electrically connect the busbar molded article and the circuit board, which are arranged in a layer structure.

With the construction described above, a complicated inner circuit can be formed without increasing the size of an electronic unit. Further, the man-hour and the cost for manufacturing the electronic unit can be reduced. Furthermore, since the electronic unit includes the busbar molded article as described above, the productivity of the electronic unit can be improved and the size of the electronic unit can be reduced.

DESCRIPTION OF THE PREFERRED EMBODIMENTS

Figure 2:
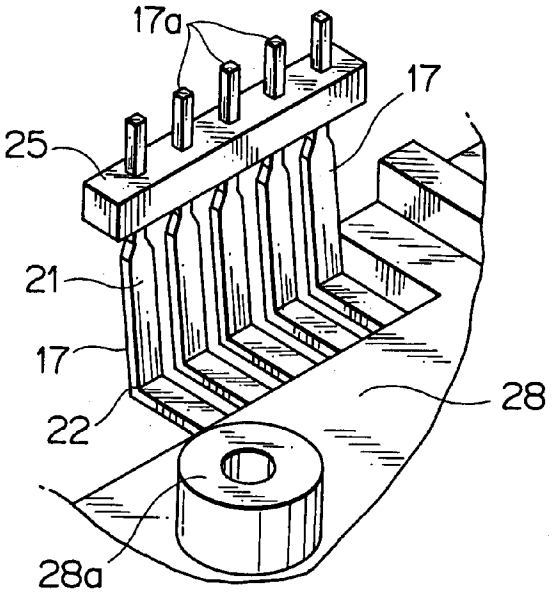
FIG. 2 is a enlarged perspective view of A part of the busbar molded article shown in FIG. 1.

In the following, the preferred embodiments of the present invention will be explained with reference to the attached drawings.

FIGS. 1–3B show a preferred embodiment of a busbar molded article and a process for manufacturing the busbar molded article according to the present invention. FIG. 4 shows a preferred embodiment of an electronic unit according to the present invention.

The busbar molded article is a molded article, which has been stamped out by using a pressing machine (not shown in the figure), bent according to the need and insert-molded together with an insulating synthetic resin, and is used as a constitutional component of an electric junction box or electronic unit. The busbar molded article 10 according to the preferred embodiment is used in an electronic unit 30 shown in FIG. 4.

The busbar molded article 10 according to the preferred embodiment can prevent the interference between a mold 45 of a pressing machine, which mold 45 moves up and down, and a resin band 25 from occurring. Thereby, it becomes unnecessary to slide a table of the pressing machine in a direction crossing at right angles with an action direction of the mold 45 after terminal parts 17, 18, 19 for substrate-connection are bent, thereby reducing the man-hour. In the busbar molded article 10, a plurality of terminal parts 17, 18, 19 are lined up on the busbar 12, which is formed by being stamped out from an electrically conductive substrate, and a resin band 25 for alignment-correction is formed in one piece on the side of an end of a plurality of the terminal parts 17, 18, 19, wherein each terminal part 17, 18, 19 is provided with: a first bent part 21 inwardly bent by a small bend angle $\theta 1$ at a lower position (i.e. on the side of a base of each terminal part) of the resin band 25; and a second bent part 22 inwardly bent by a large bend angle $\theta 2$ (i.e. $\theta 1<\theta 2$) at a position further lower than the position of the first bent part 21 by stamping with a pressing machine, so that the resin band 25 is offset in a direction of leaving from the mold 45 that moves up and down of the pressing machine. Preferably, the sum of the small bend angle θ1 and the large bend angle θ2 is 90°.

Figure 1:
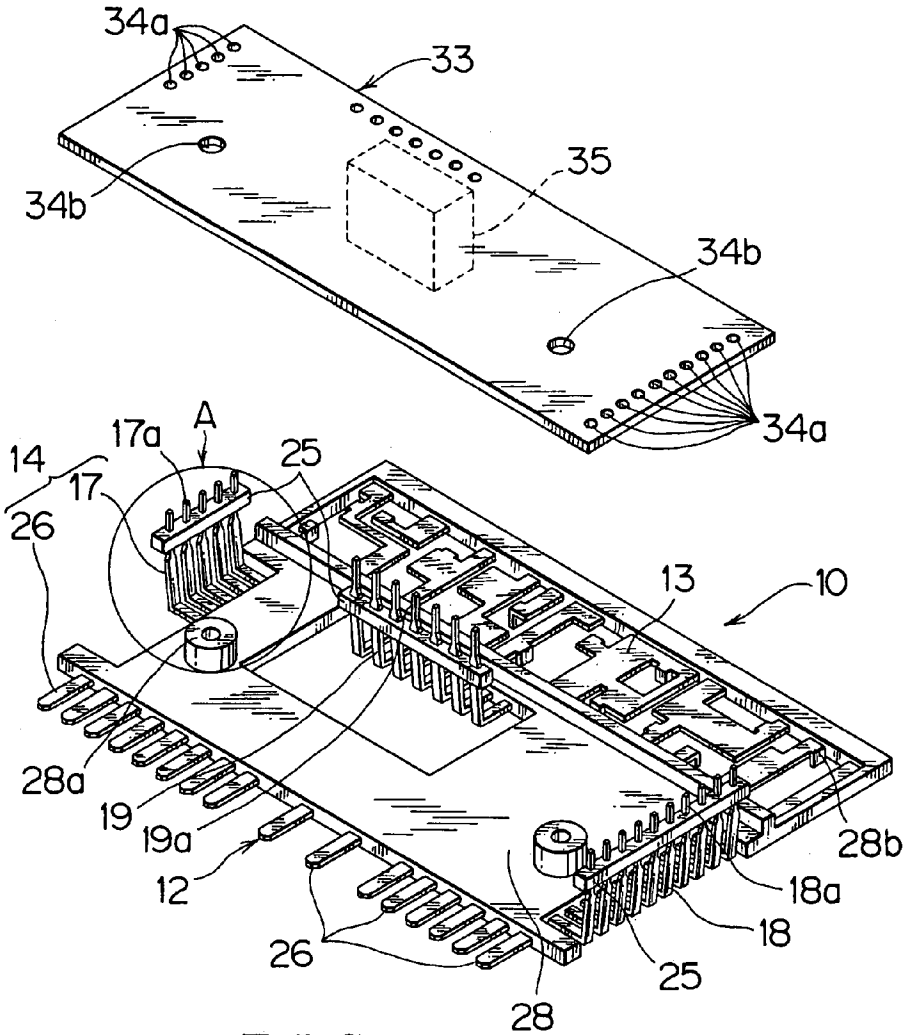
FIG. 1 is a perspective view illustrating a preferred embodiment of a busbar molded article according to the present invention.

In the following, a primary constitutional part of the busbar molded article and a process for manufacturing it according to the preferred embodiment will be explained in detail. As shown in FIG. 1, the busbar molded article 10 includes the busbar 12 and an insulating substrate 28. As described above, since the busbar 12 and the insulating substrate 28 are formed in one piece by insert-molding, the productivity of the busbar molded article 10 can be improved in comparison with a case in which the busbar molded article 10 is separated from the insulating substrate 28.

The insulating substrate 28 is made of polybutylene terephthalate (PBT) which is suitable to the insert-molding. The insulating substrate 28 insulatingly protects the busbar 12 and is formed in one piece with a busbar main body 13 which does not include the terminal parts 17, 18, 19, 26 formed on ends of the busbar 12. The front side of the insulating substrate 28 is provided with a screw hole 28*a* for screwing a printed board (i.e. circuit board) 33. The rear side of the insulating substrate 28 is provided with a relay mount 28*b* for mounting a plurality of relays shown in FIG. 4.

The busbar 12 is a circuit conductor, which is made of copper or copper alloy and is formed by stamping out by using a pressing machine according to a specific circuit pattern. The busbar 12 includes the horizontal busbar main body 13 and a group 14 of terminal parts formed at ends and center of the busbar main body 13. Since the busbar main body 13 is embedded in the insulating substrate 28, a short circuit to the outside is prevented from occurring.

The group 14 of terminal parts includes the terminal parts 17, 18, 19 for substrate-connection and the terminal parts 26 for connector-connection. The terminal parts 17, 18, 19 for substrate-connection have a tab-shape and are formed rising up from the center and both sides left and right of the busbar molded article 10. The terminal parts 17, 18 situated each side left and right face to one another, while the terminal parts 19 situated at the center is formed in a direction crossing at right angles with the line of the terminal parts 17, 18 situated each side left and right.

In this specification, the front side means the side where the terminal parts 26 for connector-connection are situated, the rear side means the side where the relays 29 (see FIG. 4) are situated, and the left and right sides mean the sides where the terminal parts 17, 18 for substrate-connection are situated.

As shown in FIG. 2, since a plurality of the terminal parts 17 are linked to one another being lined up laterally in a line by the resin band 25 for alignment-correction, which is formed by insert-molding, the terminal parts 17 are prevented from shifting such as inclining, so that the terminal parts 17 can be precisely inserted into a tab hole 34*a* formed in the printed board 33 shown in FIG. 1.

Below the resin band 25, the first bent part 21 inwardly bent by the bend angle θ1 is formed. The first bent part 21 is formed upon stamping with the pressing machine. A lower mold 46 of the pressing machine (not shown in the figure) is provided with a V-shaped recess, which the upper mold 45 is provided with a projection mating with the recess. The busbar 12 is nipped and pressed by the upper and lower molds 45, 46 so as to form the first bent part 21. The bend angle θ1 may be any value. In the preferred embodiment it is set to be about 10°. Thus, since the first bent part 21 is formed upon the stamping, the first bent part 21 can be formed without increasing the man-hour for the manufacture.

Further below the first bent part 21, the second bent part 22 is formed being bent by a large bend angle θ2 (θ1<θ2) in the same direction as that of the first bent part 21. The second bent part 22 is formed when the terminal parts 17 in its expanded state in the busbar molded article 10 set in the pressing machine is stamped between the upper and lower molds 45, 46. The bend angle θ2 is the complementary angle of the bend angle θ1 and is set about 80° in the preferred embodiment. By setting the sum of the bend angles θ1 and θ2 to be 90°, electric contacts 17*a* of the terminal parts 17 rise up vertically. Since the second bent part 22 is formed by stamping, the bending can be carried out precisely, thereby improving the productivity.

Figure 3A:
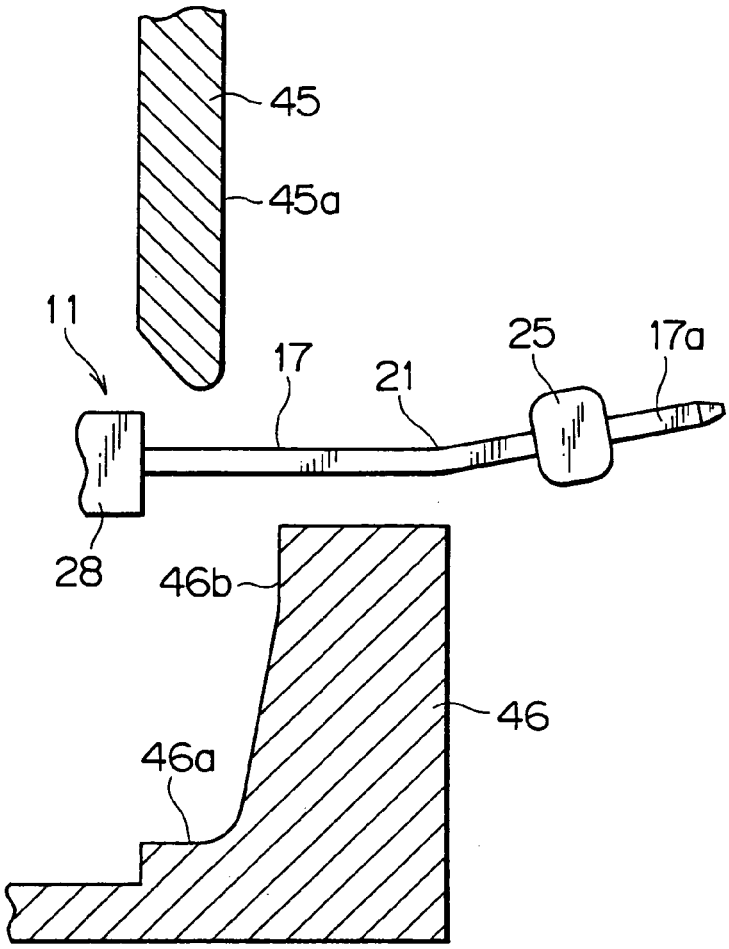
FIG. 3A is a view of a method of manufacturing the busbar molded article shown in FIG. 1 illustrating a state before stamping by pressing.
Figure 3B:
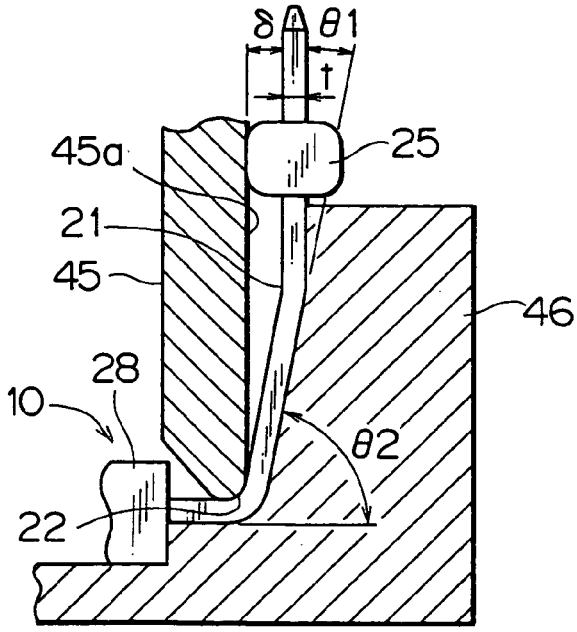
FIG. 3B is a view of a method of manufacturing the busbar molded article shown in FIG. 1 illustrating a state after stamping by pressing.
Figure 4:
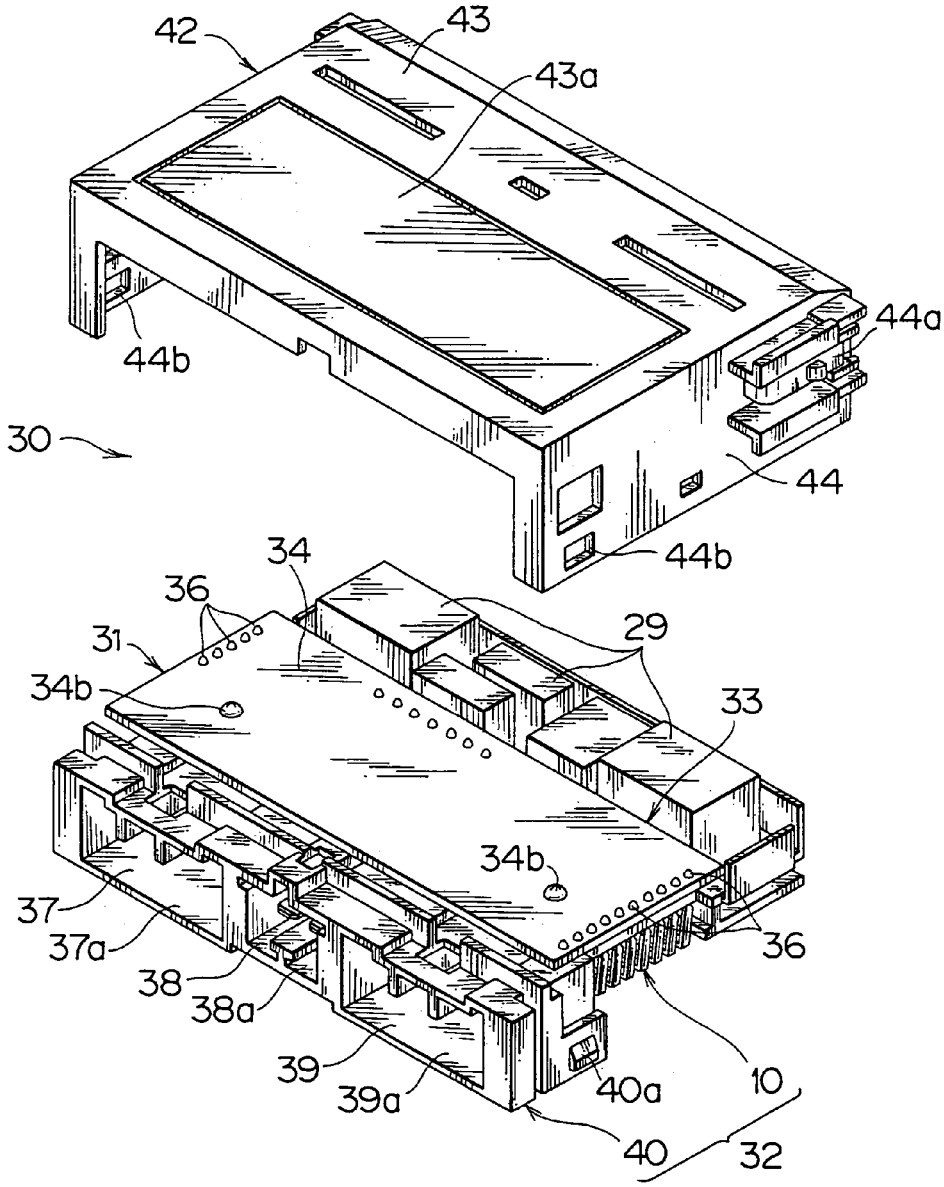
FIG. 4 is a perspective view illustrating a preferred embodiment of an electronic unit according to the present invention.
Figure 5:
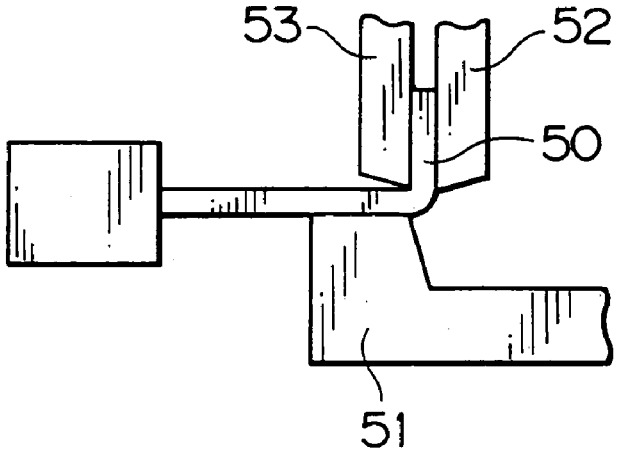
PRIOR ART FIG. 5
FIG. 5 is a view illustrating an example of a conventional method of bending a terminal part.
Figure 6:
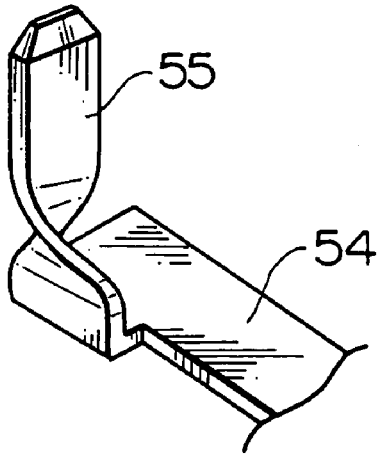
PRIOR ART FIG. 6
FIG. 6 is a perspective view illustrating another example of a conventional method of bending a terminal part.
Figure 7A:
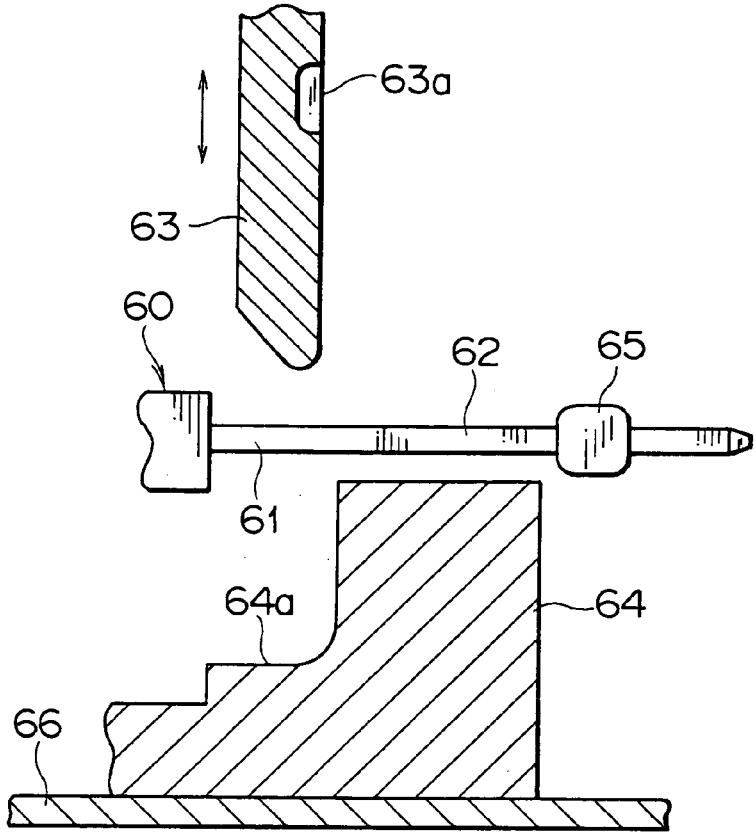
PRIOR ART FIG. 7A
FIG. 7A is a view of an example of a method of manufacturing the conventional busbar molded article illustrating a state before stamping by pressing.
Figure 7B:
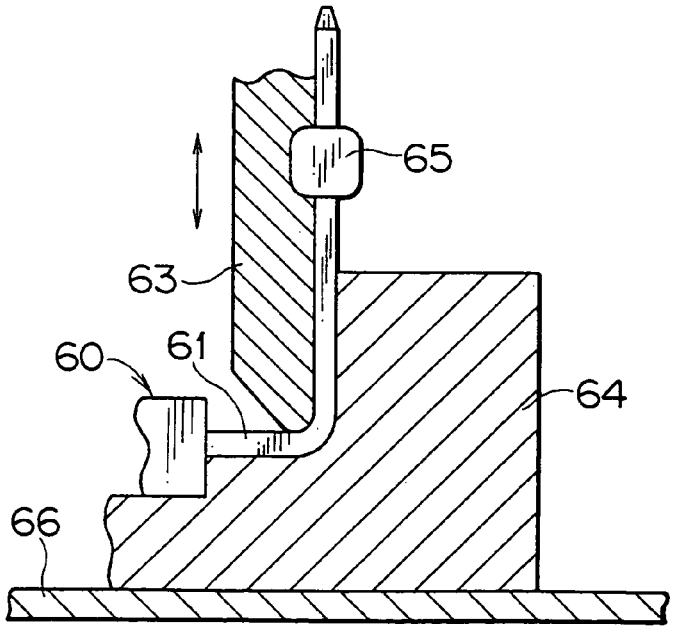
PRIOR ART FIG. 7B
FIG. 7B is a view of an example of a method of manufacturing the conventional busbar molded article illustrating a state after stamping by pressing.

FIGS. 3A and 3B show a method of manufacturing the busbar molded article shown in FIG. 1 illustrating states before and after stamping by pressing, respectively. When an intermediate molded body 11 of the busbar molded article 10, which is obtained by insert-molding the busbar 12 in its expanded state, is set on a pressing position in the pressing machine, as shown in FIG. 3A, the horizontal terminal parts 17 before bending is placed on the lower mold 46 having a L-shaped notch 46*a*. Then, as shown in FIG. 3B, when the upper mold 45 falls down to a position a little apart from a vertical wall surface 46*b* of the notch 46*a*, the base-side (i.e. the side of the base) of the terminal parts 17 is pressed by the upper mold 45 so as to be pressed into the notch 46*a*, so that the second bent part 22 bent by the bend angle θ2 is formed.

A distance between the vertical wall surface 46*b* of the notch 46*a* of the lower mold 46 and a rear surface 45*a* of the upper mold 45 that faces with the vertical wall surface 46*b* is formed being approximately equal to or larger than the sum of a plate thickness t of the terminal part 17 and the projection quantity 6 of the resin band 25. Thereby, even when the upper mold 45 is lifted upward, the mold 45, is prevented from interfering with the resin band 25. That is, without sliding a table of the pressing machine in a direction crossing at right angles with the action direction of the mold 45 that moves upward and downward, the busbar molded article 10 can be removed from the pressing machine. Therefore, an action of sliding the table becomes unnecessary, thereby reducing the man-hour for manufacture and enabling bending of the terminal parts 17, 18, 19 efficiently.

The sides of the ends of the terminal parts 17, 18, 19 are electric contacts 17*a*, 18*a*, 19*a* which mate with the printed board 33 (see FIG. 1). When the printed board 33 is overlapped on the busbar molded article 10, the electric contacts 17*a*, 18*a*, 19*a* are inserted into the tab holes 34*a* of the printed board 33 so as to directly connected to wired conductors (not shown in the figure) by soldering.

Each terminal part 26 for connector-connection has a tab-shape and formed on the front side of the busbar molded article 10. The terminal parts 26 are connected to female terminals of an external connector to be fit into connector housings 37*a*, 38*a*, 39*a* of a main body 31 of a unit. When the external connector is connected to the main body 31 of the unit, the internal circuit and the external circuit are electrically connected, thereby enabling the supply of the electric source and sending and reception of signals.

In the following, a preferred embodiment of an electronic unit according to the present invention will be explained on the basis of FIG. 4.

An electronic unit 30 includes the main body 31, electric components such as fuses and relays 29, electronic components such as diodes, resistors, transistors 35 (see FIG. 1), coils, capacitors, integrated circuits, and connectors 37, 38, 39 for connecting such circuits to external circuits. The electronic unit 30 is a communication control device for controlling auxiliary machines such as a wiper, washer, front light, foglamp and air-conditioner. For example, the electronic unit 30 is received in a casing of a relay box.

The electronic unit 30 according to the preferred embodiment is compacted by arranging the busbar molded article 32 and the printed board 33 in a layer structure. The L-shaped terminal parts 17, 18, 19 for substrate-connection, which are formed being bent on the ends of the busbar 12 and linked in a line laterally by the resin band 25, are inserted into the tab holes 34*a* of the printed board 33 so as to electrically connected to the wired conductors formed on a surface of the printed board 33.

As is shown, the electronic unit 30 includes main body 31 and a cover 42. The main body 31 of the unit 30 includes the busbar assembly 32 and the printed board 33. The busbar assembly 32 is formed with the upper and lower busbar molded articles 10 and 40 being combined, wherein the busbar molded article 10 having the terminal parts 17, 18, 19 for substrate-connection is applied as one of the busbar molded articles.

The other busbar molded article 40 is formed by insert-molding similarly to the one busbar molded article 10, wherein the front side of the busbar molded article 40 is provided with female connector housings 37*a*, 38*a*, 39*a* for mating with the external connectors.

Inside the connector housings 37*a*, 38*a*, 39*a*, horizontal terminal parts 26 formed on the end of the busbar 12 project. The connector housings 37*a*, 38*a*, 39*a* and a plurality of the terminal parts 26 constitute the internal connectors 37, 38, 39 for mating with the external connectors, so that the supply of the electric source and sending and reception of signals from ECU are carried out. The busbar molded articles 10 and 40 are positioned by positioning means such as pilot pin or pin hole and fixed with a screw.

The printed board 33 includes a board body 34 consisting of an insulating substrate and wired conductors and electronic components such as power transistors and capacitors mounted on a surface of the board body 34. The electronic components are connected to the terminal parts 17, 18, 19 for substrate-connection of the busbar molded articles 10, 40 through the wired conductors. The back surface of the board body 34 is provided with a plurality of soldering parts 36 as the connection parts of the terminal parts 17, 18, 19 and the wired conductors. Since the electronic components and the soldering parts 36 are easily affected by heat, the busbar assembly 32 that is easily heated up is placed on the upper side, while the electronic unit 30 is mounted in the relay box.

The rectangular box-shaped cover 42 is made of polybutylene terephthalate (PBT) having good moldability and heat-resisting property and resin-molded. Its outer walls consist of top wall 43 and circumferential walls 44. The bottom wall is formed open so as to face to the side of the printed board 33. The top wall 43 is provided with an aluminum plate 43*a* so as to improve the heat radiation property of the main body 31 of the unit 30. The circumferential walls 44 situated at both sides are provided with locking arms 44*a* corresponding to a wall of the relay box and locking holes 44*b*. When the locking holes 44*b* engage with locking claws 40*a*, the cover 42 is combined with the main body 31 of the unit 30.

As described above, with the busbar molded article 10 according to the preferred embodiment, by changing the shapes of the terminal parts 17, 18, 19 for substrate-connection, the interference between the mold 45 that moves upward and downward and the resin band 25 is prevented from occurring, the man-hour for the manufacture is reduced, and the terminal parts 17, 18, 19 are bent efficiently. With the electronic unit 30 according to the preferred embodiment, the productivity of the electronic unit 30 improves and the size of the electronic unit 30 can be reduced.

The aforementioned preferred embodiments are described to aid in understanding the present invention and variations may be made by one skilled in the art without departing from the spirit and scope of the present invention. For example, in the process for manufacturing the busbar molded article 10, the lower mold may be formed in the whole shape so that the first and second bent parts simultaneously can be formed. In such a case, the first and second bent parts can be formed precisely.

What is claimed is:

1. A busbar molded article comprising:

a busbar formed by being stamped out from an electrically conductive substrate;

a plurality of terminal parts lined up on the busbar; and a resin band for alignment-correction formed on the side of ends of a plurality of the terminal parts, wherein each terminal part is provided with:

a first bent part bent by a small bend angle; and a second bent part bent by a large bend angle, substantially greater than that of the small bend angle and less than 90°, by stamping with a pressing machine, the second bent part extended from the substrate and being formed nearer to the side of a base of each terminal part than the first bent part being formed, so that the resin band is offset to a mold that moves up and down of the pressing machine, wherein the sum of the small bend angle and the large bend angle is 90°.

2. An electronic unit comprising: the busbar molded article as claimed in claim 1; and a circuit board, wherein a plurality of the terminal parts electrically connect the busbar molded article and the circuit board, which are arranged in a layer structure.

3. A busbar molded article comprising: a busbar formed by being stamped out from an electrically conductive substrate;

a plurality of terminal parts lined up on the busbar; and a resin band for alignment-correction formed on the side of ends of a plurality of the terminal parts, wherein each terminal part is provided with;

a first bent part bent by a small bend angle; and a second bent part bent by a large bend angle, greater than that of the small bend angle, by stamping with a pressing machine, the second bent part being extended from the substrate and formed nearer to the side of a base of each terminal part than the first bent part being formed, so that the resin band is offset to a mold that moves up and down of the pressing machine, wherein the small bend angle is about 10° and the large bend angle is about 80°.

* * * * *